US007748495B2

(12) United States Patent
Krueger

(10) Patent No.: US 7,748,495 B2
(45) Date of Patent: Jul. 6, 2010

(54) TUBULAR LOUDSPEAKER

(76) Inventor: Paul M. Krueger, 1200 Anchorage View Ct., Baltimore, MD (US) 21224

( * ) Notice: Subject to any disclaimer, the term of this patent is extended or adjusted under 35 U.S.C. 154(b) by 201 days.

(21) Appl. No.: 11/773,290

(22) Filed: Jul. 3, 2007

(65) Prior Publication Data

US 2007/0284184 A1 Dec. 13, 2007

(51) Int. Cl.
*H04R 1/02* (2006.01)

(52) U.S. Cl. ..... 181/199; 181/144; 381/335; 381/336; 381/338

(58) Field of Classification Search ..... 181/144, 181/146, 147, 148, 196, 199; 381/87, 335, 381/336, 338, 345
See application file for complete search history.

(56) References Cited

U.S. PATENT DOCUMENTS 3,393,766 A * 7/1968 Mitchell ..... 381/300
3,978,941 A * 9/1976 Siebert ..... 181/151
4,164,988 A * 8/1979 Virva ..... 181/156
4,616,731 A * 10/1986 Robinson ..... 181/148
4,628,528 A 12/1986 Bose et al.
4,655,315 A * 4/1987 Saville ..... 181/153
4,819,761 A 4/1989 Dick
4,930,596 A 6/1990 Saiki et al.
5,025,886 A * 6/1991 Jung ..... 181/156
5,111,509 A * 5/1992 Takeuchi et al. ..... 381/338
5,191,177 A 3/1993 Chi
5,296,656 A * 3/1994 Jung ..... 181/152
5,446,793 A 8/1995 Piccaluga et al.
5,535,284 A * 7/1996 Thornhill et al. ..... 381/338
5,644,109 A 7/1997 Newman
5,664,020 A * 9/1997 Goldfarb et al. ..... 381/89
5,844,176 A 12/1998 Clark
5,889,875 A * 3/1999 Caron et al. ..... 381/338
5,892,182 A * 4/1999 Newman ..... 181/156
6,141,428 A 10/2000 Narus
6,628,792 B1 9/2003 Paddock
6,700,984 B1 3/2004 Holberg et al.
D521,977 S 5/2006 Lopez (Continued)

OTHER PUBLICATIONS

Harry F. Olson, "Direct Radiator Loudspeaker Enclosures", Journal of the Audio Engineering Society, vol. 17, No. 1, p. 22-29, Jan. 1969.

(Continued)

*Primary Examiner*—Jeffrey Donels
*Assistant Examiner*—Jeremy Luks
(74) *Attorney, Agent, or Firm*—Jefferson IP Law, LLP; Raymond B. Persino

(57) ABSTRACT

Provided is an acoustic loudspeaker comprising an enclosure and at least first and second loudspeaker drivers. The enclosure comprises at least one tubular sound channel of a substantially constant inside dimension acoustically coupled to the at least first and second loudspeaker drivers. The at least one tubular sound channel comprises a first opening disposed at a first end of the at least one tubular sound channel, a second opening disposed at a second end of the at least one tubular sound channel and a third opening disposed on the at least one tubular sound channel between the first and second ends. The second opening comprises a sound outlet for outputting sound conducted through the enclosure. The enclosure further comprises at least one tuning section disposed within the at least one tubular sound channel between the second and third openings.

16 Claims, 7 Drawing Sheets

U.S. PATENT DOCUMENTS

2002/0085731 A1* 7/2002 Aylward ..... 381/349
2004/0101152 A1* 5/2004 Fingleton ..... 381/336
2004/0105559 A1* 6/2004 Aylward et al. ..... 381/103
2005/0117767 A1* 6/2005 Ito et al. ..... 381/333
2005/0135642 A1* 6/2005 Dry ..... 381/302
2005/0180589 A1* 8/2005 Liu ..... 381/338
2005/0205349 A1* 9/2005 Parker et al. ..... 181/155

OTHER PUBLICATIONS

The 3D-Spiral Horn Speaker Building, pp. 1-7, internet publication.
Acoustical Art, pp. 1-3, internet publication.

* cited by examiner

TUBULAR LOUDSPEAKER

FIELD OF THE DISCLOSURE

The present invention relates to a loudspeaker. More particularly, the present invention relates to a tubular loudspeaker.

BACKGROUND OF THE DISCLOSURE

A loudspeaker is an electromechanical device that converts an electrical signal into sound. There are numerous types of conventional loudspeakers. Among the more common type of loudspeakers, is a loudspeaker comprising a driver that is coupled to an enclosure and/or baffle. The driver vibrates in response to an electrical signal, thereby producing front and rear sound waves. Some drivers are specifically designed to reproduce the sound for a particular range of frequencies. For example, some drivers are designed to produce mid or low frequencies while others are designed to reproduce the upper frequency range. Often these various drivers are used together in a single loudspeaker. When used together, these various drivers may be augmented through the use of crossover electronic elements, serving to divide the frequencies sent to each driver from an input source. The purpose of the enclosure or baffle is to provide a mounting area as well as separate the front and rear sound waves to provide a usable and wide frequency response. Without an enclosure or large baffle, the front and rear sound waves will combine destructively, making the output sound, particularly in the low frequencies, virtually inaudible. It is therefore then the goal of the loudspeaker enclosure to control the front and rear waves such that they combine in a constructive fashion, reinforcing frequencies and output sounds that are not reproduced by one wave or the other exclusively, or not combine at all.

One type of loudspeaker implements a "finite baffle" design. In a "finite baffle" design, direct radiating loudspeakers are mounted to a surface facing the listening position. The finite baffle is a board or similar structure, typically of several meters in width and height, to which the loudspeaker is affixed. The finite baffle is used to separate the front and rear waves of the loudspeaker. A loudspeaker based on a finite baffle design is a non-resonant design, whereby the air propagation of the cone is not harnessed in an enclosure, and the air volume of the enclosure is not utilized to damp the cone of the loudspeaker. Nevertheless. This design is noted for producing an open sound, but is limited in power handling, sound pressure (decibel) output, and excessive size, In addition, this design can only be fully realized indoors, and is strongly reliant on the effect of room placement and coupling.

Another type of loudspeaker separates the front and rear sound waves by virtue of a sealed enclosure, wherein the rear wave is confined within the enclosure, serving to reinforce the cone of the driver acting as an air spring. This is often called acoustic suspension or the "infinite baffle". This compact design, while easy to build and tune, is notoriously inefficient, limits low bass frequencies. This design can produce unwanted panel resonances or reflections within the enclosure that can be reflected back through the driver as well as non-linearities in the driver itself caused by the high air pressure changes in the enclosure. Other designs include the features of the acoustic suspension, but use an enclosure opening (port) sometimes including a tube or slot (a Helmholtz resonator) or a passive radiator driver to reinforce the front wave, allowing low frequencies to emanate from the port or radiator and dampen the driver at its resonance frequency. The tuning of these enclosures is known and can be reproduced through a defined formula. These designs are limited in producing a free and natural bass response, especially in the upper and mid bass regions, and produce unwanted panel resonances and standing waves. Still another design is set forth in U.S. Pat. No. 4,628,528 to Bose et al. suggests a waveguide enclosure (transmission line) whose length is determined by a formula of ¼ the wavelength of the chosen driver's resonance frequency, is designed as a labyrinth, and is typically constructed with an average cross sectional area 1.5-3.0 times the size of the driver. Extensive acoustical stuffing material is utilized for tuning purposes. The purpose of "stuffing" is to destroy unwanted high and middle frequencies from emanating from the rear wave and out an enclosure opening (port), where only low frequencies will exit, and recombine constructively with the front wave. "Stuffing", however; creates manufacturing problems related to repeatability, loss of efficiency, and tuning reliability issues if the stuffing moves inside the enclosure. U.S. Pat. No. 6,700,984 to Holberg et al. suggests that the use of a transmission line enclosure with non-linearly tapering walls, with largest diameter near the driver and smallest diameter near the enclosure opening. It also recommends tuning based on U.S. Pat. No. 4,628,528 to Bose et al., discussed above, wherein the length of the enclosure is determined initially by a ¼ wavelength of the desired tuning frequency, with final tuning done by adding acoustical fibers (stuffing) packed into the enclosure. This design has numerous acoustical advantages over the aforementioned designs, one being the elimination of panel resonances reflecting from the enclosure and back through the driver itself, which can produce unwanted distortion and phasing issues.

All of these designs call for a front baffle with diameter or area greater than the area of the driver itself. Inherent with a baffle is baffle losses, produced when the front sound wave bounces off the enclosure and/or the enclosure sides and is projected towards the listener, out of phase with the desired sound wave. Baffles can also limit, filter, and/or destruct the output of certain frequencies measured "off axis," most commonly 30 degrees to either side of the reference loudspeaker. The published work of engineer H. F. Olson from around 1969 is often referenced for baffle diffraction effects. The results of the research suggests the use of baffles shaped as spheres or enclosure sides progressively angled away from the driver and avoiding any 90 degree angles. All of his examples assume the baffle is substantially greater in area than the actual width of the drivers themselves, however.

Loudspeakers by their very nature are compromises; with no one design embodying all of the desired characteristics of the listener. It is therefore the object of this invention to improve upon existing and previously discussed prior art. Accordingly, there is a need for an improved loudspeaker that overcomes the above disadvantages.

SUMMARY OF THE DISCLOSURE

Exemplary embodiments of the present invention address at least the above problems and/or disadvantages and provide at least the advantages described below. Accordingly, an aspect of the present invention is to provide an acoustic loudspeaker comprising an enclosure and at least first and second loudspeaker drivers, the at least first and second loudspeaker drivers being substantially identical. The enclosure comprises at least one tubular sound channel of a substantially constant inside dimension acoustically coupled to the at least first and second loudspeaker drivers, wherein the at least one tubular sound channel comprises a first opening disposed at a first end of the at least one tubular sound channel, a second opening disposed at a second end of the at least one tubular sound channel and a third opening disposed on the at least one tubular sound channel between the first and second ends, wherein the first, second and third openings comprise an inner dimension which substantially corresponds to the inside dimension of the at least one tubular sound channel and the outside dimension of the at least first and second loudspeaker drivers, wherein the at least first and second loudspeaker drivers are coupled to the first and third openings, wherein the second opening comprises a sound outlet for outputting sound conducted through the at least one tubular sound channel from the at least first and second loudspeaker drivers. The enclosure further comprises at least one tuning section disposed within the at least one tubular sound channel between the second and third openings, the at least one tuning section running substantially parallel to the at least one tubular sound channel, wherein the at least one tuning section comprises an inside dimension that is less than the inside dimension of the at least one tubular sound channel.

Another aspect of the present invention is to provide an acoustic loudspeaker comprising and enclosure and at least first and second loudspeaker drivers, the at least first and second loudspeaker drivers being substantially identical. The enclosure comprises at least one tubular sound channel of a substantially constant inside dimension acoustically coupled to the at least first and second loudspeaker drivers, wherein the at least one tubular sound channel comprises a first opening disposed at a first end of the at least one tubular sound channel, a second opening disposed at a second end of the at least one tubular sound channel and a third opening disposed on the at least one tubular sound channel between the first and second ends, wherein the first, second and third openings comprise an inner dimension which substantially corresponds to the inside dimension of the at least one tubular sound channel and the outside dimension of the at least first and second loudspeaker drivers, wherein the at least first and second loudspeaker drivers are coupled to the first and third openings, wherein the second opening comprises a sound outlet for outputting sound conducted through the at least one tubular sound channel from the at least first and second loudspeaker drivers.

Another aspect of the present invention is to provide an acoustic loudspeaker comprising an enclosure and at least a first loudspeaker driver. The enclosure comprises at least one tubular sound channel of a substantially constant inside dimension acoustically coupled to the at least first loudspeaker driver, wherein the at least one tubular sound channel comprises a first opening disposed at a first end of the at least one tubular sound channel and a second opening disposed at a second end of the at least one tubular sound channel, wherein the first and second openings comprise an inner dimension which substantially corresponds to the inside dimension of the at least one tubular sound channel and the outside dimension of the at least first loudspeaker driver, wherein the at least first loudspeaker driver is coupled to the first opening, wherein the second opening comprises a sound outlet for outputting sound conducted through the at least one tubular sound channel from the at least first loudspeaker driver. The enclosure further comprises at least one tuning section disposed within the at least one tubular sound channel between the first and second openings, the at least one tuning section running substantially parallel to the at least one tubular sound channel, wherein the at least one tuning section comprises an inside dimension that is less than the inside dimension of the at least one tubular sound channel.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
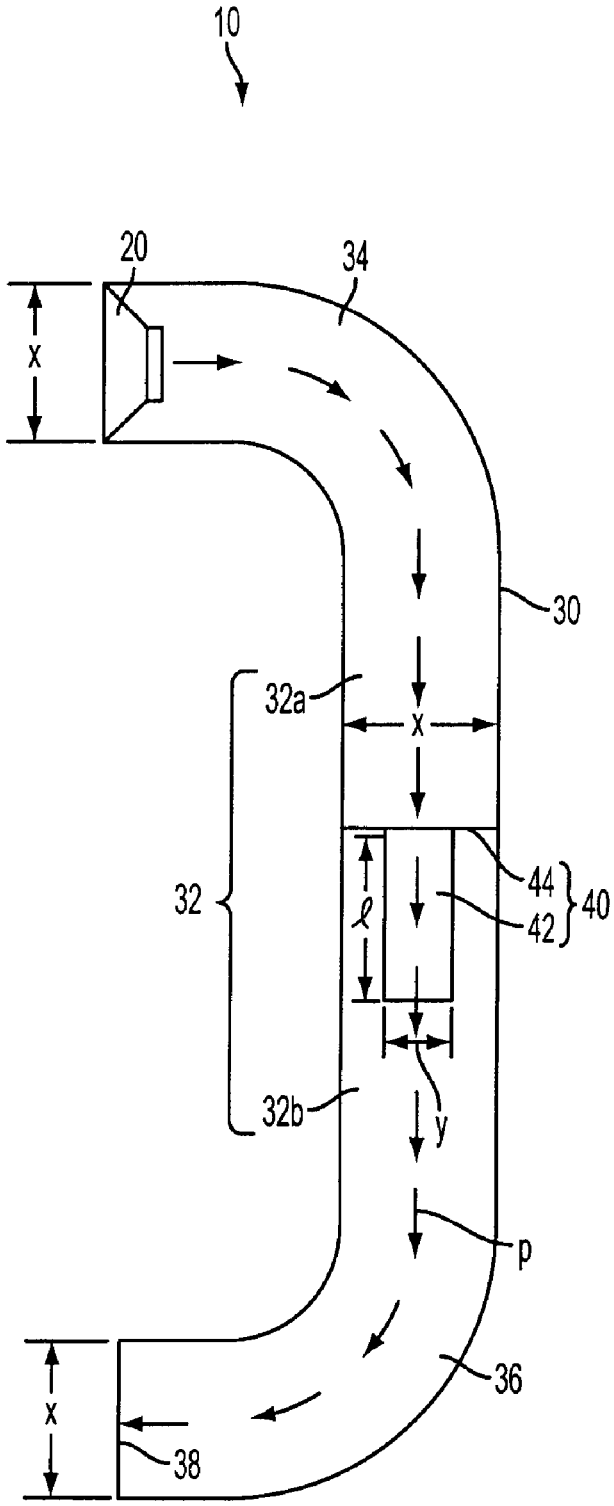
FIG. 1 illustrates a cross-sectional view of a loudspeaker according to an exemplary embodiment.
Figure 2:
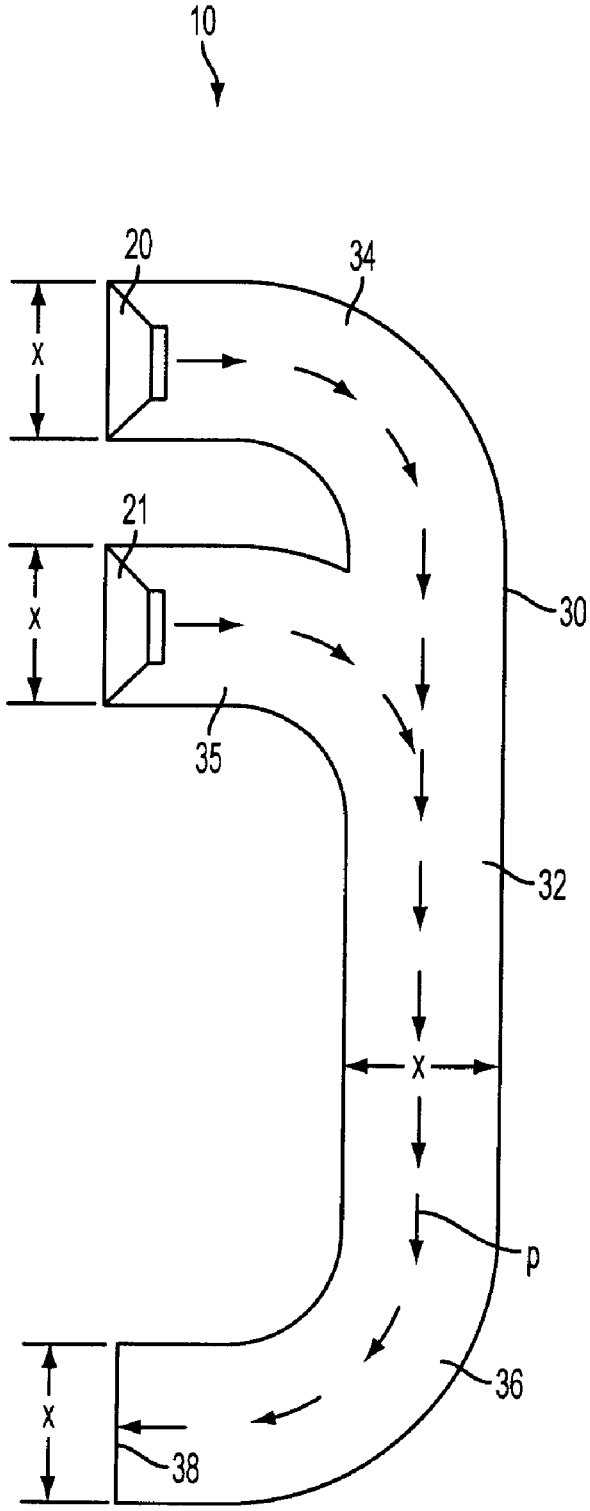
FIG. 2 illustrates a cross-sectional view of a loudspeaker according to another exemplary embodiment.
Figure 3:
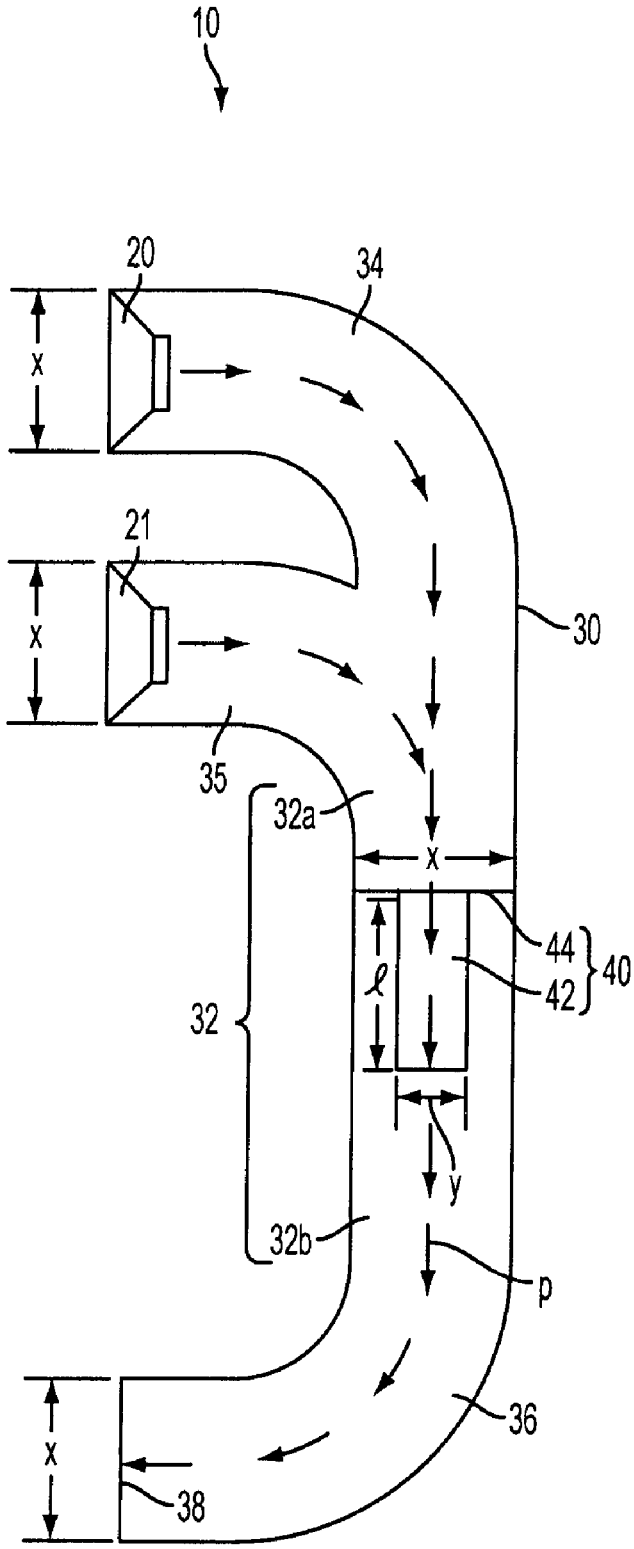
FIG. 3 illustrates a cross-sectional view of a loudspeaker according to still another exemplary embodiment.

FIGS. 1-3 illustrate a cross-sectional view of a loudspeaker according to various exemplary embodiments. Each of the exemplary embodiments of loudspeaker 10, at the least, comprise driver 20 and enclosure 30. Enclosure 30, at the least, comprises various sections including a linear sound channel 32, input curvilinear sound channel 34, output curvilinear sound channel 36 and sound opening 38. For the sake of brevity, at least a portion of the features that are common in the exemplary embodiments shown in FIGS. 1-3 are discussed below.

As illustrate in FIGS. 1-3, enclosure 30 may be substantially tubular with a substantially constant inside dimension 'x' throughout its various sections, including linear sound channel 32, input curvilinear sound channel 34, output curvilinear sound channel 36, and sound opening 38. The cross-sectional tubular shape of enclosure 30 may be square, elliptical, circular, triangular or any other shape that can be used to form a tube. In other embodiments, enclosure 30 is any structure that is formed with sound channels that have a substantially constant inside dimension 'x', wherein the sound channels are effectively equivalent to sound channels formed by a tubular enclosure. Inside dimension 'x' may be any of a diameter, cross-sectional area, width, or any other dimension. The use of a tubular shape for the sound channels serves to minimize unwanted panel related resonances within the enclosure.

The total length of the sound channel of enclosure 30 is defined as the length of a line running through the center of enclosure 30 from sound opening 38 to the opening in enclosure 30 to which driver 20 is mounted. It is preferred that the length of the sound channel of enclosure 30 be about 8-12 times the inside dimension 'x'. Further, it is preferred that any curvilinear sound channels be formed with a smooth radius as shown by example in FIGS. 1-3. In addition, in some embodiments, adjacent sections of enclosure 30 may share at least a portion of a common wall.

Figure 4:
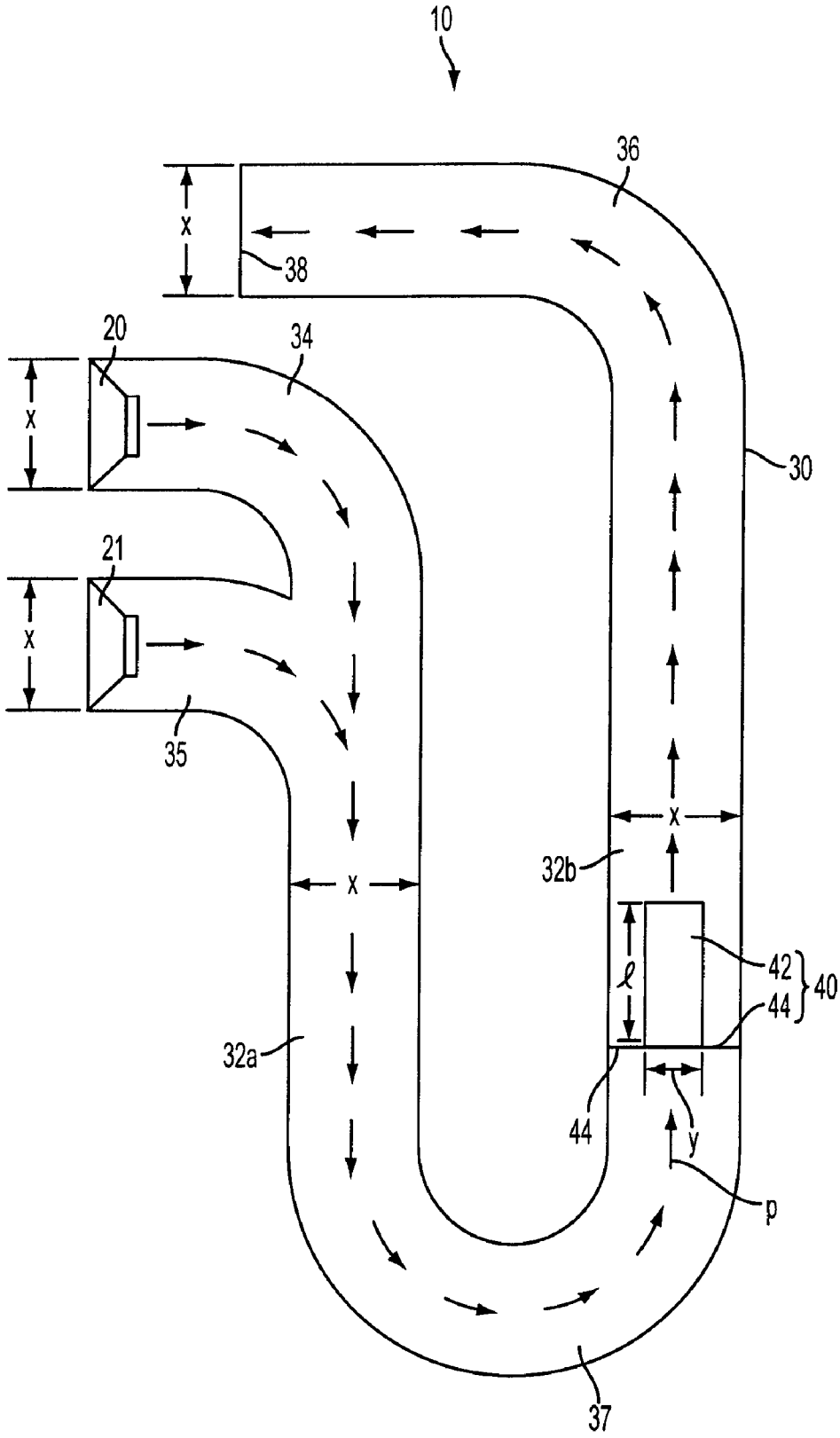
FIG. 4 illustrates a cross-sectional view of a loudspeaker according to yet another exemplary embodiment.

The structures illustrated in FIGS. 1-3 for enclosure 30 are merely exemplary embodiments for enclosure 30. It would be apparent to one of skill in the art that variations to the location, lengths and number of linear sound channels and the location, radius and number of curvilinear sound channels may be made within the scope of the embodiments of the present inventions. For example, FIG. 4 illustrates an exemplary structure for loudspeaker 10 that includes an additional curvilinear sound channel 37 of about 180 degrees that is disposed near the midpoint of enclosure 30.

Enclosure 30 may be constructed in one of various ways. In one embodiment, enclosure 30 may be constructed of plural sections that are mated together by glue, friction fitted, clamped, screwed, or held together by any other manner of retaining two structures together. For example, the plural sections may be conventional PVC pipe sections that are frictionally and removably coupled together. In another embodiment, enclosure 30 may be formed as two clamshells that are mated together. In yet another embodiment, enclosure 30 may be formed as a single body in either tubular form or with the sound channels formed within.

Enclosure 30 may be formed of plastics, polymers, polycarbonate, polyvinyl chloride (PVC), chlorinated polyvinyl chloride (PVC), pc/abs blend, nylon 66, abs, aluminum, steel, carbon fiber, resin, stainless steel, wood or any other rigid material.

Drivers, such as driver 20 in FIGS. 1-3 and drivers 21 in FIGS. 2 and 3, are mounted at an open end of a sound channel so as to be mechanically and acoustically coupled to enclosure 30 such that substantially all sound emerging from the back side of driver 20 is captured by enclosure 30. The captured sound propagates along path 'p', passing though tuning section 40, before exiting to free atmosphere through sound opening 38.

While the choice of a driver depends on the desired size and characteristics of loudspeaker 10, as would be apparent to one of ordinary skill in the art, it is preferred that driver selection be made within the constraints discussed below. Preferably, the driver(s) may be one of a full range, midrange, midbass, bass, or subwoofer driver as is known in the art. It is preferred that the driver(s) be selected such that it has substantially the same shape as the cross-sectional tubular shape used for the sound channels in enclosure 30. Further, it is preferred that the driver(s) be selected such that its dimension is substantially the same as the inside dimension 'x' of enclosure 30.

Preferably, the tubular enclosure walls of enclosure 30 extend away from driver 20, in an opposite direction to the front of the driver(s), a sufficient distance so as to substantially minimize the tubular enclosure walls of enclosure 30 from acting as a baffle. Accordingly, enclosure 30 is structured such that sound produced from the front of the driver(s) is not substantially reflected and deflected off the exterior of the tubular enclosure walls of enclosure 30, thereby enhancing off axis sound level response.

In some embodiments, an annular deflecting ring (not shown) is disposed at about, and extends away from, the junction between the driver(s) and the open end of the sound channel where the driver(s) are mounted. Preferably, as the annular deflecting ring extends away from the junction between the driver(s) and the open end of curvilinear sound channel 34 where the driver(s) are mounted, the surface of annular deflecting ring closest to the driver(s) smoothly curves away from the driver(s). The cross sectional shape of the curve may be may be linear, exponential, hyperbolic, parabolic, a "tractrix" or any combination thereof. In addition, the cross sectional shape may be any other type of or combination of types of curves or shapes. In some embodiments, the annular deflecting ring is integral to enclosure 30. Further, in other embodiments, the inside dimension of the open end of a sound channel where the driver(s) are installed may be larger than dimension 'x' in the area adjacent to the driver(s).

Preferably, sound opening 38 is oriented in that same direction as the front of driver 20, as shown in FIG. 1. Further it is preferred that sound opening 38 be located in that same plane as the driver(s). However, in other embodiments, sound opening 38 may be oriented in any other direction and lie in any other plane. Further, while it is preferred that sound opening 38 be substantially baffle-less in a similar manner to that discussed above with respect to driver 20, sound opening 38 in some embodiments may be implemented with a baffle, horn or an annular deflective ring. Still further, sound opening 38 may be fitted with a passive radiator.

Preferably, a least a portion of the interior walls of the enclosure are lined with a fibrous sound-absorbing material of approximately ¼-½ inch in thickness. In some embodiments, enclosure 30 is at least partially stuffed with fibrous sound-absorbing material at approximately ½ pound per cubic foot of volume. In still other embodiments, one or more sections of enclosure 30 may be stuffed with fibrous sound-absorbing material while one or more other sections may be lined with the fibrous sound-absorbing material. In the embodiments where at least a portion of enclosure 30 is stuffed with the fibrous sound-absorbing material, varying the amount of fibrous sound-absorbing material may vary the tuning of enclosure 30. Accordingly, if enclosure 30 is to be at least partially tuned by varying the amount of fibrous sound-absorbing material stuffed in enclosure 30, it is preferred that the amount of sound-absorbing material be determined by trial and error. The fibrous sound-absorbing material when stuffed or lined serves as a transmission medium for assisting in the projection of lower frequency audible sound through enclosure 30. The fibrous sound-absorbing material when stuffed or lined also dampens any possible resonance generated and attenuates higher frequencies. The fibrous sound-absorbing material may be formed of polyester, nylon, fiberglass or any other sound-absorbing material.

In some other embodiments, sound opening 38 and/or the driver(s) may include a grill formed of a sound penetrable material such as a decorative metal screen. When implemented with sound opening 38 a grill is adapted for preventing any extraneous materials from entering enclosure 30 through sound opening 38 and may prevent any sound-absorbing material from leaving enclosure 30 through sound opening 38. When implemented with the driver(s), a grill operates as a protective barrier.

While FIGS. 1-3 illustrate the preferred orientation for loudspeaker 10, loudspeaker 10 may be oriented in any other manner, such as horizontally or at an angle In some embodiments, all or a portion of enclosure 30 may be fitted within a decorative enclosure and/or wall. Further, enclosure 30 may be fitted with a mounting member for mounting enclosure 30 to a support bracket. Still further enclosure 30 may be fitted with a crossover and/or amplifier that is electrically coupled to driver 20. In addition, wiring for energizing the driver 20 is at least partially routed through enclosure 30.

While some features that are common to the exemplary embodiments shown in FIGS. 1-3 have been discussed above, not all features that are common have been discussed above and not all features discussed above are common to all of the exemplary embodiments. The exemplary embodiments illustrated in FIGS. 1-3 will now be discussed below.

FIG. 1 illustrates a cross-sectional view of a loudspeaker according to an exemplary embodiment. As shown in FIG. 1, loudspeaker 10 consists of a driver 20 and enclosure 30. Enclosure 30 comprises various sections including a linear sound channel 32, input curvilinear sound channel 34, output curvilinear sound channel 36 and sound opening 38. A tuning section 40 is disposed within enclosure 30. Hereafter, the portion of linear sound channel 32 between input curvilinear sound channel 34 and tuning section 40 will be referred to as first linear sound channel 32*a* and the portion of linear sound channel 32 between tuning section 40 and output curvilinear sound channel 36 will be referred to as second linear sound channel 32*b*.

Herein, in the exemplary embodiment illustrated in FIG. 1, the captured sound from driver 20 propagates along path 'p', passing though tuning section 40, before exiting to free atmosphere through sound opening 38.

Tuning section 40 is disposed within enclosure 30 between driver 20 and sound opening 38. As shown in FIG. 1, tuning section 40 comprises a linear tuning channel 42 of length 'l' with a constant inside dimension 'y', wherein inside dimension 'y' is less than inside dimension 'x' of linear sound channel 32. Further, tuning section 40 may includes a holding member 44 that supports linear tuning channel 42 within enclosure 30. Holding member 44 and linear tuning channel 42 may be constructed of separate components or formed as a single component. Further, tuning section 40 may be separately formed from enclosure 30 or internally formed therewith. Holding member 44 acoustically isolates first linear sound channel 32*a* from second linear sound channel 32*b* in the space between the enclosure 30 and the linear tuning channel 42. Accordingly, first linear sound channel 32*a* and second linear sound channel 32*b* are acoustically coupled through linear tuning channel 42.

Preferably, the inside dimension 'y' of linear tuning channel 42 is about ½ to ⅔rd of the inside dimension 'x' of linear sound channel 32. Further, it is preferred that the length of linear tuning channel 42 be about $\frac{1}{5}^{th}$ to $\frac{1}{10}$th the total length of enclosure 30. Still further, it is preferred that the portion of linear tuning channel 42 closest to driver 20 be disposed at about the midpoint of enclosure 30. When loudspeaker 10 is properly tuned it will exhibit lower distortion and a flatter impedance. It is difficult to form a mathematical model for tuning enclosure 30 so a trial and error methodology may be implemented for tuning enclosure 30. In embodiments where fibrous sound-absorbing material is at least partially stuff in enclosure 30, tuning is further carried out by adjusting the amount of fibrous sound-absorbing material that is stuffed in enclosure 30.

Figure 5:
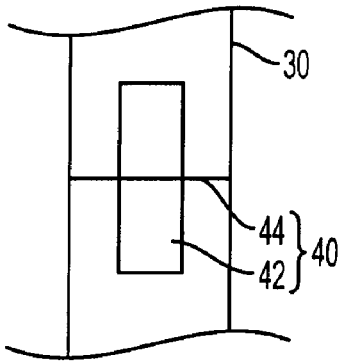
FIG. 5 illustrates a cross-sectional view of a tuning section according to an exemplary embodiment.
Figure 6:
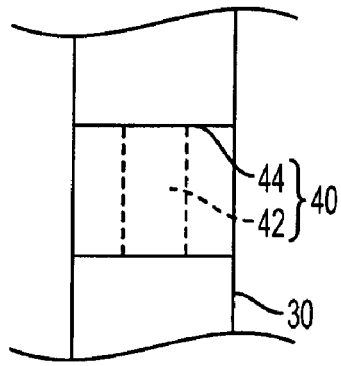
FIG. 6 illustrates a cross-sectional view of a tuning section according to another exemplary embodiment.
Figure 7:
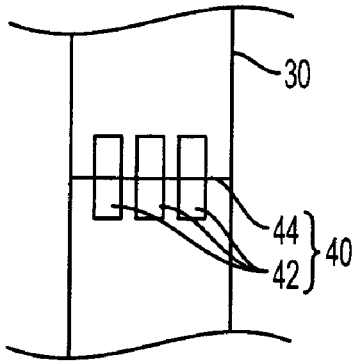
FIG. 7 illustrates a cross-sectional view of a tuning section according to still another exemplary embodiment.
Figure 8:
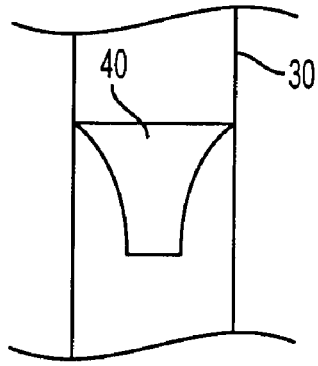
FIG. 8 illustrates a cross-sectional view of a tuning section according to yet another exemplary embodiment.

The tuning section 40 depicted in FIG. 1 is merely one example of various embodiments for the structure for tuning section 40. For example, while mounting member 44 is illustrated in FIG. 1 as being disposed at one end of the linear tuning channel 42, in some embodiments mounting member 44 may be disposed at any other position along linear tuning channel 42, such as in the middle of linear tuning channel 42, as depicted in FIG. 5. Further, while mounting member 44 is depicted as being relatively thin in comparison to the length 'l' of the linear tuning channel 42, mounting member 44 may be any thickness up to length 'l' of linear tuning channel 42, as shown in FIG. 6. Still further, tuning section 40 may be formed using a plurality of linear tubes 42, as shown in FIG. 7. In addition, tuning section 40 may be tapered with one end having substantially the same dimension 'x' of linear sound channel 32 and the other end having inside dimension 'y,' as shown in FIG. 8. The tapering may be linear, exponential, hyperbolic, parabolic, a "tractrix" or any combination thereof. In addition, the tapering may be any other type or combination of types of tapering. Further, while a tapered tuning section 40 may be installed in either direction within enclosure 30, it is preferred that tuning section 40 be oriented such that the larger end of a tapered tuning section 40 is closer to driver 20.

In some embodiments more than one tuning section 40 is disposed within enclosure 30. When more than one tuning section 40 is disposed within enclosure 30, any number of the more than one tuning sections 40 may be different from or identical to one another.

In other embodiments, one or more passive radiators and/or additional drivers may be implemented in addition to or substituted for tuning section 40 within enclosure 30. When used with tuning section 40, the one or more passive radiators and/or additional drivers may be disposed in either one or both of first linear sound channel 32*a* and second linear sound channel 32*b*. When an additional driver is used it is preferred that the additional driver be substantially identical to driver 20.

In operation, when driver 20 is electrically energized, it emits sounds that are forwardly propagated as well as back propagated through enclosure 30. The sounds are back propagated through enclosure 30, passing through tuning section 40, before being projected from sound opening 38 substantially in phase with the sound forwardly projected from the driver 20. The implantation of tuning section 40 improves the bass response while reducing the enclosure size and/or length. Further, the use of tuning section 40 reduces the need for stuffing of the enclosure with acoustic fiber fill material and the related losses and tuning problems associated with same. Accordingly, tuning section 40 may simplify the tuning of enclosure 30. Also, because of the substantially synchronous phasing generated through the tubular enclosure, audible sound transmission is essentially distortion free with greater extension. Further, by not implementing a conventional baffle, baffle losses are avoided.

FIG. 2 illustrates a cross-sectional view of a loudspeaker according to another exemplary embodiment. As shown in FIG. 2 loudspeaker 10 consists of a driver 20, additional driver 21 and enclosure 30. Enclosure 30 comprises various sections including a linear sound channel 32, input curvilinear sound channel 34, additional input curvilinear sound channel 35, output curvilinear sound channel 36 and sound opening 38.

As illustrate in FIG. 2, enclosure 30 includes additional input curvilinear sound channel 35, which is disposed between driver 21 and linear sound channel 32. The additional input curvilinear sound channel 35 is disposed on linear sound channel 32 between driver 20 and sound opening 38. Additional input curvilinear sound channel 35 is disposed on linear sound channel 32 such that the distance between driver 21 and sound opening 38 through the sound channel in enclosure 30 is approximately ⅝ to ⅞ the distance between driver 21 and sound opening 38 through the sound channel in enclosure 30. Additionally input curvilinear sound channel 35, like the other portions of enclosure 30, comprises substantially constant inside dimension 'x'. Further, it is preferred that driver 20 and driver 21 be substantially identical. The use of at least two drivers with enclosure 30 increases the level of sound output from enclosure 30.

While the embodiment illustrated in FIG. 2 reflects the preferred number, type and arrangement of drivers, it would be apparent to one of skill in the art that variations to the number, type and arrangement of drivers could be made within the scope of the embodiments of the present inventions. For example, more than two drivers and respective sound channels may be implemented as long as all of the drivers are substantially identical to one another. Accordingly, an array of drivers may be implemented using an single enclosure 30 by adding combinations of a driver and input curvilinear sound channel along linear sound channel 32.

In operation, when driver 20 and driver 21 are electrically energized, they emits sounds that are forwardly propagated as well as back propagated through enclosure 30. The sounds back propagated through enclosure 30 are projected from sound opening 38 substantially in phase with the sound forwardly projected from the driver 20. The suggested arrangements of the drivers 20 and 21 and the path of the directed sound waves have the net effect of shortening the required length or volume of the enclosure 12 while providing maximum acoustical benefits, including the likelihood of providing addition destruction of upper and mid frequencies from reaching sound opening 38. Also, because of the substantially synchronous phasing generated through the tubular enclosure, audible sound transmission is essentially distortion free with greater extension and decibel output. Further, by not implementing a conventional baffle, baffle losses are minimized or avoided.

FIG. 3 illustrates a cross-sectional view of a loudspeaker according to yet another exemplary embodiment. As shown in FIG. 3 loudspeaker 10 consists of a driver 20, additional driver 21 and enclosure 30. Enclosure 30 comprises various sections including a linear sound channel 32, input curvilinear sound channel 34, additional input curvilinear sound channel 35, output curvilinear sound channel 36 and sound opening 38. A tuning section 40 is disposed within enclosure 30. The portion of linear sound channel 32 between input curvilinear sound channel 34 and tuning section 40 will be referred to as first linear sound channel 32*a* and the portion of linear sound channel 32 between tuning section 40 and output curvilinear sound channel 36 will be referred to as second linear sound channel 32*b*.

The exemplary embodiment illustrated in FIG. 3 includes tuning section 40 discussed above with respect to FIG. 1. Further, exemplary embodiment illustrated in FIG. 3 includes additional driver 21 and additional input curvilinear sound channel 35 discussed above with respect to FIG. 2. Accordingly, explanation of the tuning section 40, additional driver 21 and additional input curvilinear sound channel 35 will not be repeated below.

As illustrated in FIG. 3, tuning section 40 is preferably disposed between additional input curvilinear sound channel 35 and sound opening 38. However, in other embodiments, tuning section 40 is disposed between input curvilinear sound channel 34 and additional input curvilinear sound channel 35. In yet other embodiments, any number of combinations of driver and input curvilinear sound channel may be implemented above and/or below tuning section 40.

In operation, when driver 20 and driver 21 are electrically energized, they emit sounds that are forwardly propagated as well as back propagated through enclosure 30. The sounds are back propagated through enclosure 30, passing through tuning section 40, before being projected from sound opening 38 substantially in phase with the sound forwardly projected from the driver 20. The embodiment illustrated in FIG. 3 combines many of the features of the embodiments illustrated in FIGS. 1 and 2 and therefore experiences many of the same benefits. For example, the implantation of tuning section 40 improves the bass response while reducing the enclosure size and/or length. Further, the use of tuning section 40 reduces the need for stuffing of the enclosure with acoustic fiber fill material and the related losses and tuning problems associated with same. Accordingly, tuning section 40 may simplify the tuning of enclosure 30.

Also, the suggested arrangements of the drivers 20 and 21, the path of the directed sound waves and the arrangement of the tuning section 40 have the net effect of shortening the required length of the enclosure 12 while providing maximum acoustical benefits. Additionally, because of the substantially synchronous phasing generated through the tubular enclosure, audible sound transmission exhibits reduced distortion, greater extension, and increased decibel output. Further, by not implementing a baffle, baffle losses are avoided.

Figure 9:
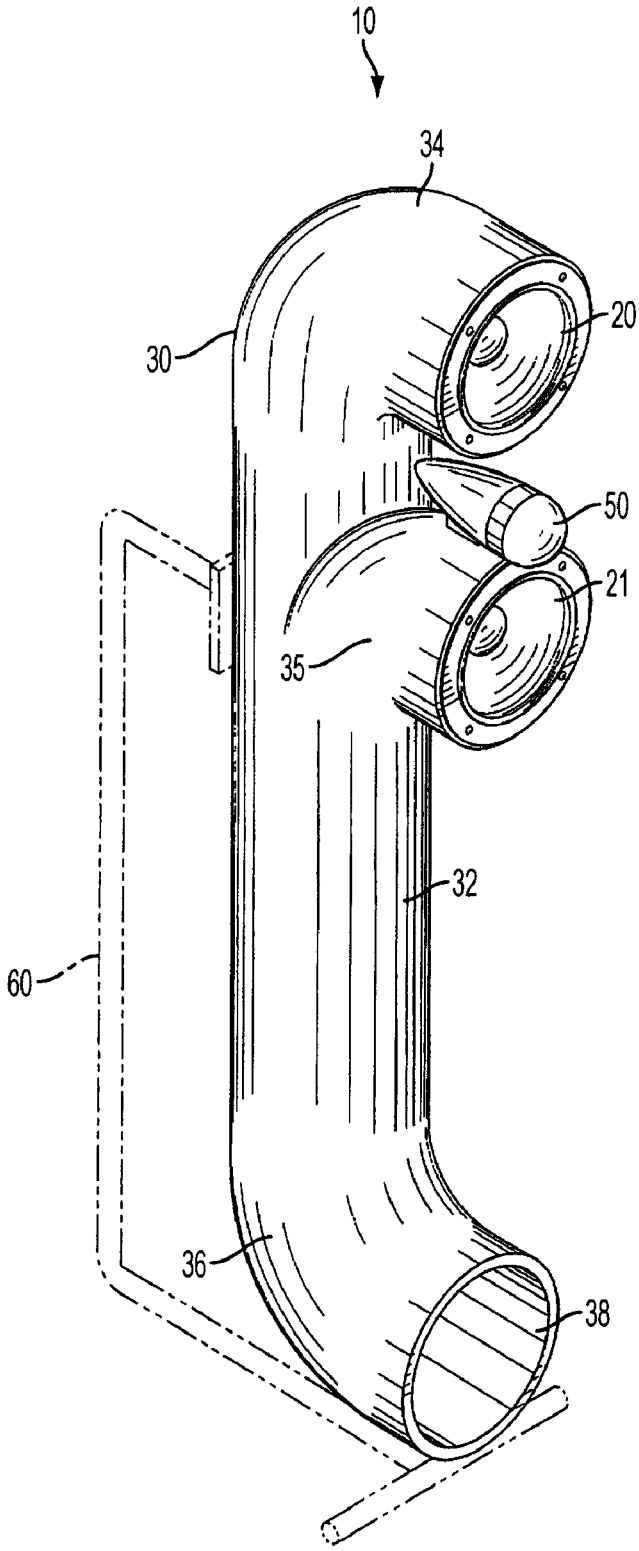
FIG. 9 illustrates a perspective view of an exemplary commercial embodiment of loudspeaker implementing the embodiment illustrated in FIG. 3.

FIG. 9 illustrates a perspective view of an exemplary commercial embodiment of loudspeaker 10 implementing the embodiment illustrated in FIG. 3. The features discussed above with respect to FIGS. 1-3 are equally applicable to the embodiment shown in FIG. 9. Accordingly, descriptions of such features will be omitted from the discussion below.

As can be seen in FIG. 9, loudspeaker 10 is fitted with high frequency driver 50 that is mechanically but not acoustically coupled to enclosure 30. The particular implementation of the drivers 20, 21 and 50 illustrated in loudspeaker 10 is merely exemplary. In the embodiment illustrated in FIG. 9, drivers 20, 21 and 50 are configured as a 2-way D'Appolito array wherein drivers 20 and 21 are substantially low frequency drivers and driver 50 is a high frequency driver. Further, a stand 60 is illustrated in FIG. 9 as supporting loudspeaker 10. This stand is merely exemplary as any other mounting or supporting structure may be used with load speaker 10.

In FIG. 9, each of the drivers 20, 21 and 50 are oriented in substantially the same direction toward the primary listening area. However, in other embodiments the drivers 20, 21 and 50 may be arranged such that they any number of them are oriented in different directions. For example, the drivers 20, 21 and 50 may be arranged in a dipole or tripole arrangement as is known in the art. Further, while it is preferred that sound opening 50 be oriented toward the primary listening direction, sound opening 50 may alternately be oriented in any other direction as discussed above. Further, drivers 20, 21 and 50 and sound opening 38 are illustrated as being disposed on the same plane. However, any of drivers 20, 21 and 50 and sound opening 38 may alternatively be disposed on differing planes, such as planes that are parallel to one another.

In some embodiments additional drivers may be mechanically but not acoustically coupled to enclosure 25. For example, midrange drivers (not shown) could be disposed between driver 20 and driver 50 and between driver 50 and driver 21 respectively. In this embodiment, the drivers are configured as a 3-way D'Appolito array. In these embodiments drivers 20 and 21 remain the only drivers acoustically coupled to enclosure 30. Still further, the midrange drivers could alternatively be disposed on either side of high frequency driver 50 so as to not be located between driver 20 and driver 50 and between driver 50 and driver 21.

Figure 10:
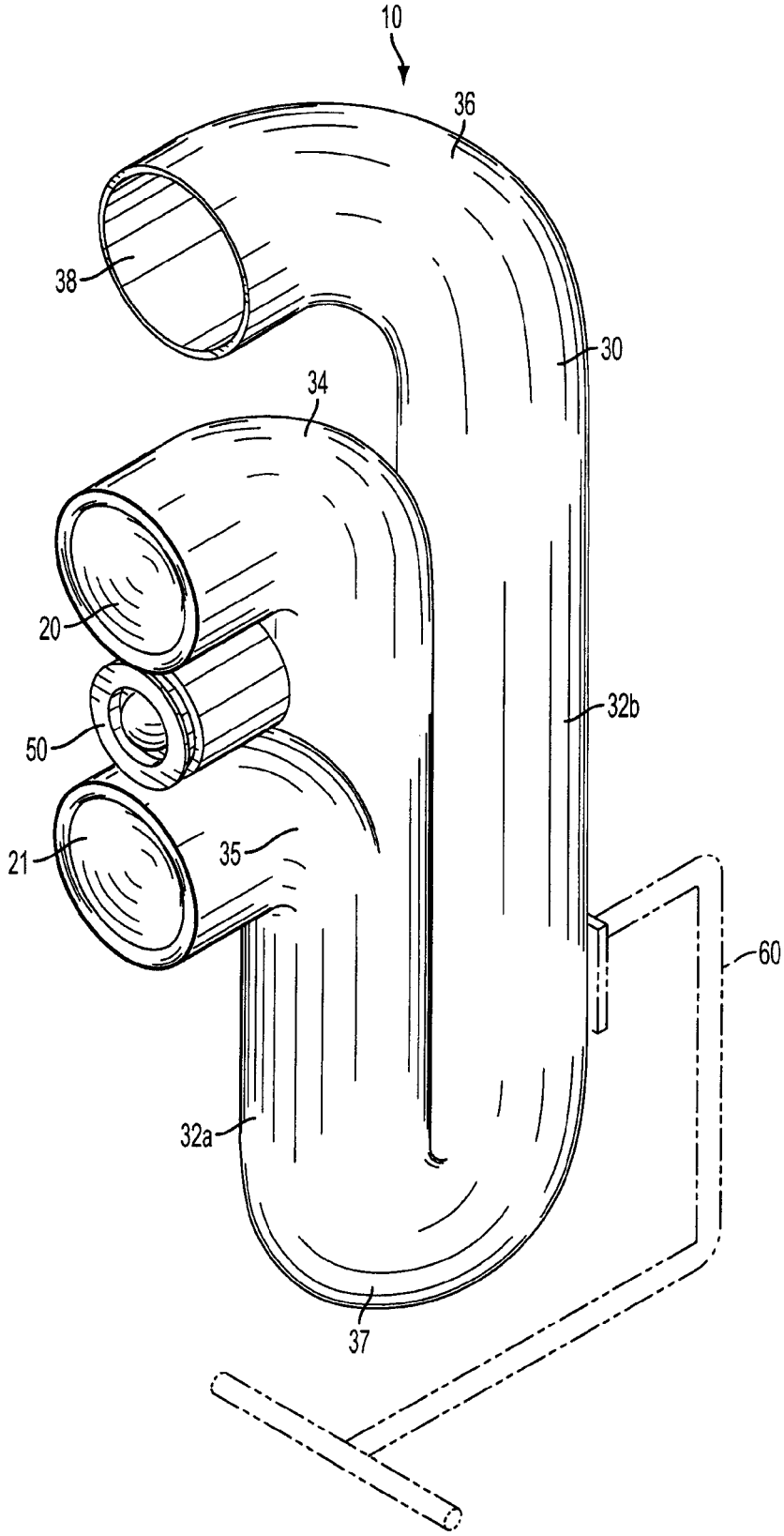
FIG. 10 illustrates a perspective view of an exemplary commercial embodiment of loudspeaker implementing the embodiment illustrated in FIG. 4.

FIG. 10 illustrates a perspective view of an exemplary commercial embodiment of loudspeaker 10 implementing the embodiment illustrated in FIG. 4. The features discussed above with respect to FIGS. 1-3 and 9 are equally applicable to the embodiment shown in FIG. 10. Accordingly, descriptions of such features will be omitted. FIG. 10 illustrates a different exemplary embodiment for drivers 20, 21 and 50 and stand 60 than those depicted in FIG. 9.

A single loudspeaker 10 may be used to reproduce monaural sound or a pair of loudspeakers 10 may be utilized together for stereo reproduction, one for the left and right channels. Still further, a plurality of loudspeakers 10 may be used for multi-channel or surround sound reproduction.

While certain exemplary embodiments of the invention have been shown and described herein with reference to certain preferred embodiments thereof, it will be understood by those skilled in the art that various changes in form and details may be made therein without departing from the spirit and scope of the invention as defined by the appended claims and their equivalents.

The invention claimed is:

1. An acoustic loudspeaker comprising:

at least first and second loudspeaker drivers, the at least first and second loudspeaker drivers being substantially identical; and an enclosure comprising:

at least one tubular sound channel of a substantially constant inside dimension acoustically coupled to the at least first and second loudspeaker drivers, wherein the at least one tubular sound channel comprises a first opening disposed at a first end of the at least one tubular sound channel, a second opening disposed at a second end of the at least one tubular sound channel and a third opening disposed on the at least one tubular sound channel between the first and second ends, wherein the first, second and third openings comprise an inner dimension which substantially corresponds to the inside dimension of the at least one tubular sound channel and the outside dimension of the at least first and second loudspeaker drivers, wherein the at least first and second loudspeaker drivers are coupled to the first and third openings, wherein the second opening comprises a sound outlet for outputting sound conducted through the at least one tubular sound channel from the at least first and second loudspeaker drivers, and at least one tuning section disposed within the at least one tubular sound channel between the second and third openings, the at least one tuning section running substantially parallel to the at least one tubular sound channel, wherein the at least one tuning section comprises an inside dimension that is less than the inside dimension of the at least one tubular sound channel.

2. The acoustic loudspeaker of claim 1, wherein the tuning section comprises at least one of a tubular tuning section and a tapering tuning section.

3. The acoustic loudspeaker of claim 1, wherein the first and third openings are oriented in a substantially identical direction and are each located in substantially parallel or similar planes.

4. The acoustic loudspeaker of claim 3, wherein the sound outlet is oriented in substantially the same direction as the first and third openings.

5. The acoustic loudspeaker of claim 1, wherein interior walls of the enclosure are substantially lined with a fibrous sound-absorbing material.

6. The acoustic loudspeaker of claim 1, wherein the at least first and second loudspeaker drivers are coupled to the first and third openings without use of a baffle.

7. The acoustic loudspeaker of claim 1, wherein the length of a line running through the center of the tubular sound channel from first loudspeaker driver to the sound outlet is 8-12 times the constant inside dimension of the at least one tubular sound channel.

8. The acoustic loudspeaker of claim 1, wherein the length of a line running through the center of the tubular sound channel from the second loudspeaker driver to the sound outlet is approximately ⅝ to ⅞ the distance between the length of a line running through the center of the tubular sound channel from the first loudspeaker driver to the sound outlet.

9. The acoustic loudspeaker of claim 1, wherein the tuning section comprises a tubular tuning section comprising an inside dimension that is about ½ to ⅔rd of the inside dimension or the tubular sound channel and comprising a length of about ⅕ to ⅒ the length of a line running through the center of the tubular sound channel from the first loudspeaker driver to the sound outlet.

10. An acoustic loudspeaker comprising:

at least first and second loudspeaker drivers, the at least first and second loudspeaker drivers being substantially identical; and an enclosure comprising:

at least one tubular sound channel of a substantially constant inside dimension acoustically coupled to the at least first and second loudspeaker drivers, wherein the at least one tubular sound channel comprises a first opening disposed at a first end of the at least one tubular sound channel, a second opening disposed at a second end of the at least one tubular sound channel and a third opening disposed on the at least one tubular sound channel between the first and second ends, wherein the first, second and third openings comprise an inner dimension which substantially corresponds to the inside dimension of the at least one tubular sound channel and the outside dimension of the at least first and second loudspeaker drivers, wherein the at least first and second loudspeaker drivers are coupled to the first and third openings, wherein the second opening comprises a sound outlet for outputting sound conducted through the at least one tubular sound channel from the at least first and second loudspeaker drivers, and at least one tuning section disposed within the at least one tubular sound channel between the second and third openings, wherein the sound conducted through the at least one tubular sound channel from the at least first and second loudspeaker drivers passes through the at least one tuning section before being output by the sound outlet, wherein the at least one tuning section comprises a passive radiator.

11. The acoustic loudspeaker of claim 10, wherein the first and second openings are oriented in a substantially identical direction and are each located in substantially parallel or similar planes.

12. The acoustic loudspeaker of claim 11, wherein the sound outlet is oriented in substantially the same direction as the first and third openings.

13. The acoustic loudspeaker of claim 10, wherein interior walls of the enclosure are substantially lined with a fibrous sound-absorbing material.

14. The acoustic loudspeaker of claim 10, wherein the at least first and second loudspeaker drivers are coupled to the first and third openings without use of a baffle.

15. The acoustic loudspeaker of claim 10, wherein the length of a line running through the center of the tubular sound channel from first loudspeaker driver to the sound outlet is 8-12 times the constant inside dimension of the at least one tubular sound channel.

16. The acoustic loudspeaker of claim 10, wherein the length of a line running through the center of the tubular sound channel from the second loudspeaker driver to the sound outlet is approximately ⅝ to ⅞ the distance between the length of a line running through the center of the tubular sound channel from the first loudspeaker driver to the sound outlet.

* * * * *